United States Patent [19]

Draai et al.

[11] 4,435,067

[45] Mar. 6, 1984

[54] METHOD AND APPARATUS FOR TRANSFERRING AND FIXING POWDER IMAGES

[75] Inventors: Willem T. Draai, Blerick; Jozef J. A. Pleyers, Baarlo; Nicolaas P. J. Kuin, Grubbenvorst, all of Netherlands

[73] Assignee: Océ-Nederland B.V., Venlo, Netherlands

[21] Appl. No.: 407,127

[22] Filed: Aug. 11, 1982

[30] Foreign Application Priority Data

Aug. 19, 1981 [NL] Netherlands ..... 8103867

[51] Int. Cl.[3] ..... G03G 15/16; G03G 15/20

[52] U.S. Cl. ..... 355/3 TR; 355/3 FU; 355/77; 430/126

[58] Field of Search ..... 355/3 TR, 3 R, 77, 14 TR, 355/3 FU; 430/33, 48, 126, 124, 97; 118/106

[56] References Cited

U.S. PATENT DOCUMENTS

| | | | |
|---|---|---|---|
| 2,990,278 | 6/1961 | Carlson | 430/126 X |
| 3,013,878 | 12/1961 | Dessauer | 430/126 |
| 3,318,212 | 5/1967 | Rubin . | |
| 3,820,985 | 6/1974 | Gaynor et al. | 355/3 R |
| 3,893,761 | 7/1975 | Buchan et al. | 355/3 R |
| 3,923,392 | 12/1975 | Buchan et al. | 355/3 R |
| 3,947,113 | 3/1976 | Buchan et al. | 355/3 TR |
| 3,961,951 | 6/1976 | Mayer et al. | 430/126 X |

*Primary Examiner*—Richard L. Moses

*Attorney, Agent, or Firm*—Albert C. Johnston

[57] ABSTRACT

Powder images are transferred and fixed onto receiving supports of absorbent material such as paper so as to form copies of fine quality without need for heating or for applying solvent vapors to make the images sticky, by forming each powder image of water-absorbent powder particles that soften on absorbing water, transporting the powder image on a resiliently deformable, hydrophobic support surface to a transfer zone for transfer under pressure onto the receiving material, and in a treatment zone spaced ahead of the transfer zone covering the hydrophobic support surface and the powder image with water and directly afterward squeegeeing water from the wetted image and support surface.

8 Claims, 1 Drawing Figure

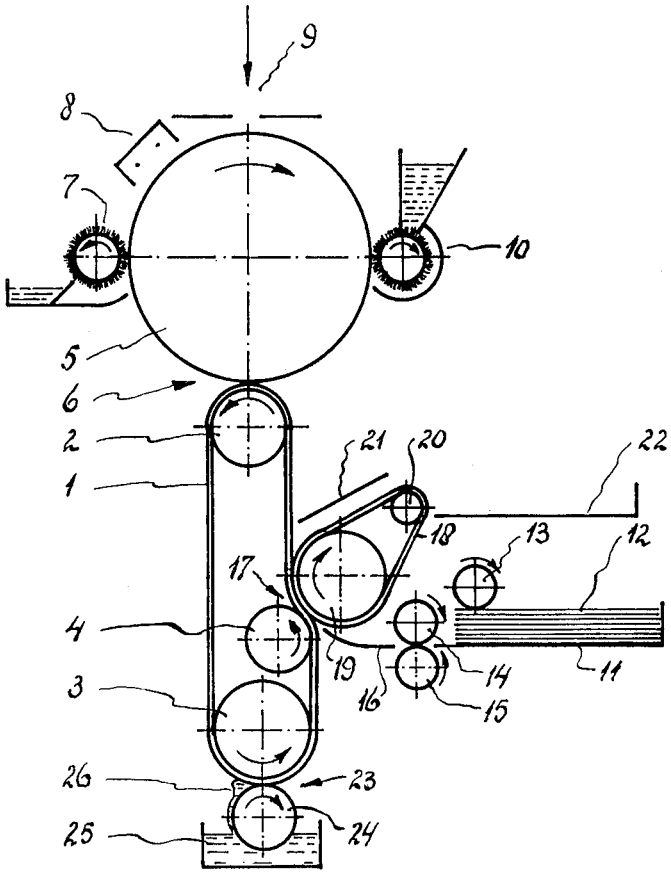
9
8
7
10
5
6
2
1
21
20
22
18
13
12
17
4
19
14
11
3
16
15
26
23
25
24

METHOD AND APPARATUS FOR TRANSFERRING AND FIXING POWDER IMAGES

This invention relates to a method and an apparatus for transferring powder images from a moving support surface under pressure onto paper or similarly absorbent receiving material and thereby fixing the powder images to the receiving material.

Methods and devices are known, for instance as disclosed in U.S. Pat. Nos. 3,318,212 and 3,893,761, in which a powder image being transported on a resiliently deformable intermediate support surface is softened and thus rendered sticky while present on that surface and then is transferred and fixed onto a paper receiving support under the influence of pressure.

U.S. Pat. No. 3,893,761 describes an electrophotographic copying apparatus in which an image of thermoplastic powder particles is formed on a photoconductive image carrier and then, in a first transfer stage, is transferred from the image carrier under the influence of pressure onto a moving intermediate support having a resiliently deformable surface. The intermediate support and the powder image present on it are heated to a temperature, typically in the range of 90°–130° C., at which the powder of the image softens to such an extent that it becomes sticky. Then, in a second transfer stage, the sticky powder image is transferred from the intermediate support to a paper sheet under the influence of pressure. In this stage fused powder particles penetrate into the pores between the paper fibers, so that the image while cooling adheres firmly to the paper and is thus fixed.

That known method is advantageous in that copies of very fine quality can be produced by its use, but it also involves important disadvantages. A principal disadvantage is that, particularly when employed with a copying apparatus having a high copying capacity, for instance of 40–120 copies per minute, a great deal of energy is required to bring and maintain the intermediate support and the powder image to the temperature required for softening the powder of the image. Furthermore, as a result of radiation and conduction, a major portion of the heat energy is lost and hence will cause objectionable heating of the copying apparatus and its surroundings.

The method disclosed in U.S. Pat. No. 3,318,212 is similar to that mentioned above but differs in that the softening of the powder image is effected by passing the intermediate support with the powder adhering thereto through a space filled with the vapor from a solvent such as trichloroethylene, freon or a liquid hydrocarbon. With this method, although the energy consumption can be relatively low, there is a serious disadvantage in that the solvents employed are volatile, give off unpleasant fumes, and involve risks of polluting the environment.

The principal object of the present invention is to provide a method and an apparatus for transferring and fixing powder images, by which the advantages of the known methods mentioned above can be obtained with avoidance of the stated disadvantages. Thus the invention enables transfer of powder images from a moving support surface to paper or like receiving material and immediate fixing of the images so as to form copies of fine quality, and enables doing so at high copy production rates, without need for either heating the images or applying solvent vapors to them.

According to the present invention the stated object is achieved by a method which comprises forming the powder images of water-absorbent powder particles that soften on absorbing water, transporting each powder image on a resiliently deformable, hydrophobic support surface to a transfer zone for transfer there under pressure to a paper or similarly absorptive receiving material, and in a treatment zone spaced ahead of the transfer zone covering the hydrophobic support surface and the powder image with water and directly afterward squeegeeing water from them so as substantially to dry the hydrophobic support surface. In an apparatus for carrying out this method, the covering with water and the squeegeeing can both be effected by means of a roller that is held in pressure contact with and rolled over the moving support surface and has a portion of its periphery immersed in a bath of water.

The support surface employed for transporting the powder images typically is a resiliently deformable surface of an intermediate support, such as an endless belt or a roller, provided for taking up the images by transfer from a photoconductive carrier on which they are formed and for carrying them to a second transfer zone for transfer and fixation to the receiving material. Materials suitable for forming the resiliently deformable hydrophobic support surface include, for example, the types of rubber used for covering the so-called rubber blanket cylinders in offset printing machines. Silicone rubbers are also particularly suitable.

Water-absorbent imaging powders suitable for use in carrying out the present invention are also essentially known per se. Such powders, for example, are described in French Pat. No. 1,369,344 as being useful in methods in which a support for receiving a powder image is completely moistened with water before or after image transfer. Such methods, however, are disadvantageous in that the copies produced must be dried in a manner requiring considerable energy and/or time before they can be handled normally.

In the method according to the invention, as a result of the water-absorbing character of the image powder on the one hand and the hydrophobic nature of the intermediate support on the other hand, during the consecutive covering with water and squeegeeing of the intermediate support only the powder image is moistened. Surprisingly it has been found that, notwithstanding the forces which are exerted on the powder particles during squeezing of them by the squeegee element, and by flow of the water that is squeezed away, details of the powder image are retained. A possible explanation for this result is that, although the image powder has absorbed water, at the moment of being squeezed it has not yet softened since the softening process requires a certain interval of time. Thus, the powder particles, having not yet softened, can still be forced at least partially into the deformable surface of the intermediate support by the squeegee element rolling over them, becoming held to it so firmly that they are not washed or forced away.

Since only the image powder on the support surfaces remains moistened after the squeegeeing, the support surface itself is substantially dry at the moment when it is brought into pressure contact with the receiving support for transfer of the powder image which in the meantime has softened. Thus, the receiving support is hardly moistened at all. Upon coming into contact with the receiving support, the water present in the powder of the image is absorbed almost immediately by the paper fibers, but this is such a small quantity of water that it does not noticeably change the normal moisture content of the receiving support. A rapid exchange of water takes place between the image powder and the paper, and this gives a further advantage in that the image is dried extremely rapidly during and is fixed by the pressure contact. Thus a dry copy is obtained which can be handled directly after image transfer has taken place.

It will be evident that when the image material after drying on the paper retains its original water-absorptive nature, it may become sticky again if it again comes into contact with water. The image material, however, is forced between the paper fibers by the pressure contact during the transfer, and thus is difficult to reach; so the image obtained is sufficiently rub resistant that under normal conditions the copy can be used without risk of damage to the image. On the other hand, if the copies to be made are to be handled under conditions in which they become moist, then the operations can be modified to improve the rub resistance of the transferred powder images so that the copies will also be stationary under such conditions. For this purpose, a cross-linking agent for the binder resin present in the powder particles can be added to the water employed for moistening the powder image. The choice of this cross-linking agent of course depends on the type of binder resin present in the powder. It has been found, for instance, that hexamethoxymelthylamine is a very suitable cross-linking agent for hydroxyl- and/or carboxyl-containing binder polymers. The amount of cross-linking agent in the water can be small and usually need not exceed more than one to several percent by weight.

The method according to the invention can be employed for transferring and fixing powder images that are formed directly, e.g. by any of various known electrographic methods, on the resiliently deformable, hydrophobic support surface. The low energy requirement and environmental suitability of this method, however, make it particularly attractive for use as part of a graphic, electrophotographic or magnetographic process in which the powder images are initially formed on an image carrier and then are transferred from it onto an intermediate support under the influence of pressure and/or an electric or magnetic field before being transferred and fixed to the final receiving material.

Since the copies obtained when employing the present method are ready for use and need no drying or cooling down before being satisfactory for handling, piling or other use, the method is also particularly attractive for the production of copies printed on both sides. Such copies can be obtained by performing the method twice, applying an image first to one side and then directly afterward to the other side of a receiving support.

Although the method according to the invention is particularly suitable for transferring and fixing powder images onto paper, it will be obvious that other receiving support materials can also be used if their behavior in respect of moisture absorption is similar to that of paper.

The above mentioned and other objects, features and advantages of the invention will be further evident from the following description and the accompanying schematic drawing of an illustrative embodiment of the invention.

The drawing illustrates schematically components of an electrographic copying machine provided with apparatus for carrying out the method herein set forth. This apparatus includes an intermediate image support 1 in the form of an endless belt which is tensioned over rollers 2, 3 and 4 and is driven over these rollers in the direction indicated by arrows, for example at a speed of 15 m/min.

The belt 1 comprises a flexible support, made for example of rubber-impregnated fabric, provided with a resiliently deformable, hydrophobic top layer. A suitable top layer may be, for example, a layer about 0.1–1 mm thick of a commercially available silicone rubber having an intrinsic hardness of 30°–70° Shore A, such as the material known as RTV 200 (Possehl Chemie+-Kunststoff GmgH, W. Germany) or Silastic E (Dow Corning Corp., U.S.A.).

The belt 1 in the illustrated embodiment is arranged to move in contact with a photoconductive cylinder 5 of known construction, which is driven in the direction indicated by an arrow at a circumferential speed equal to the surface speed of belt 1. The surfaces of the cylinder 5 and the belt 1 are held together under pressure in a first pressure contact, or transfer, zone 6. Ancillary devices as normally employed in an electrophotographic copying machine are arranged at stations spaced apart about the cylinder 5. These devices include a cleaning device 7, an electrostatic charging device 8, an optical system 9 (not shown in detail) by means of which the image of an original to be copied can be projected onto the surface of cylinder 5, and a magnetic brush developing device 10.

The copying apparatus is also provided with a tray 11 for holding a stack of cut paper sheets 12, from which the sheets can be removed individually with the aid of a rotatable friction roller 13 and can then be conveyed by rollers 14 and 15 over a guide plate 16 and thence into a second pressure contact, or transfer, zone 17 in the path of movement of the belt 1. In zone 17 each sheet thus fed is pressed by suitable pressure means, for instance by a conveyor belt 18 trained under tension over rollers 19 and 20, against a portion of belt 1 that is engaged with and passing roller 4. After leaving zone 17, the sheet is conveyed by belt 18 along the guide 21 and then is deposited on a copy tray 22.

In a third zone 23 along the path of belt 1, which as viewed in the direction of the belt movement is spaced ahead of zone 17 at a location between zones 6 and 17, the belt 1 is held and moves in pressure contact with a squeegee roller 24. The roller 24, for example, comprises a cylindrical metal core covered by a smooth layer of rubber and is driven in the direction indicated by an arrow at the same surface speed as belt 1. A lower portion of the circumference of roller 24 is immersed in a quantity of water which is present in a bath 25. As the roller 24 is rotated it carries water on its surface from bath 25, and the water so carried is held back in front of the pressure contact zone 23, thus forming a meniscus 26 from which excess water will flow back over roller 24 into the water bath 25.

The operation of the apparatus is as follows: A latent charge image is formed on cylinder 5, in the manner normally employed in electrophotography, by successively cleaning, charging electrostatically, and imagewise exposing an area of the photoconductive surface of the cylinder. The latent image is then developed into a visible powder image by the application of developing powder to it from device 10. Then the resulting powder image is carried into the first transfer zone 6 where, under the influence of the pressure exerted by the resiliently deformable surface of belt 1, the power image is forced into the surface of belt 1 and, as a result, adheres to belt 1 so as to be transferred from cylinder 5 onto belt 1. By employing a suitably selected pressure in zone 6, adapted to the degree of hardness of the top layer of belt 1, such a strong adhesion can be obtained between belt 1 and the powder image that an extremely high transfer yield, amounting for instance to 85-95% of the original powder content of the image, can be obtained on the surface of belt 1.

The belt 1 then carries the adherent powder image into the treatment zone 23 where, on entering the water meniscus 26 present ahead of the nip between the belt surface and roller 24, the powder image is covered and thus wetted by water in the meniscus. Directly afterward, on traversing the pressure contact nip of zone 23, the covering water is squeezed away from the powder image and the belt surface of the pressure in the nip between the roller 24 and the belt surface. While passing through the meniscus the powder particles of the image absorb water that is retained during passage of the image through the nip of zone 23, yet the pressure exerted in the nip causes the particles to be at least partially pressed into the surface of the belt 1 so that the image is not displaced by the squeezing action. Due, however, to the squeezing and also to the hydrophobic character of the belt surface, substantially all water that has been applied to the surface of belt 1 is kept back. Thus upon traversing the nip of zone 23, the surface of the belt is substantially dry and only the powder image adhering to it remains moistened.

While the moistened powder image is being carried toward the second transfer zone 17 by the belt 1 the image particles soften and become deformable and sticky. Then, upon entering zone 17, the softened powder image is brought into contact under pressure with a sheet of paper that has been fed in the meantime by the rollers 14 and 15. By this action the image particles are forced against and between the fibers of the paper sheet and become firmly fixed to the sheet. Since the image particles on being pressed against the paper give off any free water content to the adjacent paper fibers, the powder image of the copy leaving the transfer zone 17 is itself both dried and durably bonded with the paper. Hence a dry and fixed copy is obtained which can be handled immediately upon being deposited on tray 22 by conveyor belt 18. By correct choice of the pressure in zone 17, it can be ensured that all the powder particles of an image adhere and are transferred to the paper, while by correct choice of the length of the pressure contact zone 17 it can be ensured that the powder image on the copy sheet is dry when it leaves that zone.

It will be evident that any of various known means may be provided for adjusting and setting the pressure in each of the zones 6, 17 and 23 to values which are appropriate to the particular materials employed for the contacting belt and/or roller surfaces; and also that such values can easily be established empirically.

In order to avoid image blurring, steps naturally will be taken to ensure that the image carrier 5, the intermediate support 1, the moistening roller 24 and the image receiving material are moved forward at precisely the same speed, and also that the feeding of the image receiving sheets is in synchronism with the image formation and transfer of the powder image to the intermediate support. Many forms of mechanical, electrical and electronic control systems are known by means of which this synchronism can be ensured.

It will be obvious that the invention can be carried out with the use of apparatus differing in many ways from the embodiment herein described. For instance, a photoconductive belt can be employed instead of a photoconductive cylinder, or an intermediate support in the form of a drum can be used instead of a belt-like intermediate support.

We claim:

1. A method of transferring and fixing powder images onto receiving supports such as of paper, which comprises transporting through a treatment zone, on a moving, resiliently deformable, hydrophobic support surface, a powder image formed of water-absorbent particles that soften on absorbing water; in said zone covering the hydrophobic support surface and the powder image on said surface with water and directly afterward squeegeeing water from said surface and the image thereon; and thereafter contacting the moistened powder image on the support surface with a said receiving support under pressure, thereby transferring and fixing the powder image in moist and softened state onto the receiving support.

2. A method according to claim 1, said sqeegeeing being effected by rolling a curved surface under pressure over said support surface.

3. A method according to claim 1, said covering with water and said squeegee being effected by passing said support surface with the powder image thereon through a meniscus of water formed at a nip between said support surface and a roller surface pressed against and moving with it, and then passing the same through said nip.

4. A method according to claim 3, and maintaining said meniscus by passing said roller surface through a bath of water.

5. A method according to claim 1, 2, 3, or 4, said contacting of the moistened powder image with a receiving support being effected by pressing the receiving support against and moving it with the image on said support surface under pressure and during a length of travel sufficient for adhering the image particles to, and absorbing free moisture from them into, the receiving support.

6. A method according to claim 5, and initially forming said powder image on a moving image support and then transferring the powder image from the image support to said support surface by contact with and pressure against the support surface in a zone of travel thereof ahead of said treatment zone.

7. Apparatus for transferring and fixing powder images onto receiving supports such as of paper, comprising a continuously movable support having a resiliently deformable, hydrophobic surface to receive a powder image and transport it to a zone for transfer to a said receiving support, an image treatment zone in the path of said support surface at a location spaced ahead of said transfer zone, and means in said treatment zone for covering the hydrophobic support surface and the powder image on said support surface with water and directly thereafter squeegeeing water from the image and the support surface.

8. Apparatus according to claim 7, said covering and squeegeeing means comprising a roller having a peripheral surface moved in pressure contact with said support surface and having a portion of its periphery immersed in a bath of water.

* * * * *